US006758053B2

(12) United States Patent
Kim et al.

(10) Patent No.: US 6,758,053 B2
(45) Date of Patent: Jul. 6, 2004

(54) COOLING APPARATUS

(75) Inventors: Chang-Nyeun Kim, Seoul (KR); Jae-Seung Lee, Hwasung (KR); Chun-Taeg Kim, Kwangiu (KR); Yoon-Young Kim, Suwon (KR); Minoru Yonemura, Kwangiu (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/413,407

(22) Filed: Apr. 15, 2003

(65) Prior Publication Data

US 2004/0083746 A1 May 6, 2004

(30) Foreign Application Priority Data

Nov. 6, 2002 (KR) ..... 10-2002-0068499

(51) Int. Cl.[7] ..... F25B 41/00; F25B 39/02

(52) U.S. Cl. ..... 62/198; 62/204; 62/525

(58) Field of Search ..... 62/198, 200, 199, 62/526, 525, 204

(56) References Cited

U.S. PATENT DOCUMENTS 4,083,196 A * 4/1978 Karll ..... 62/200
4,227,379 A * 10/1980 Oonishi ..... 62/198
5,896,753 A 4/1999 Kwak et al. ..... 62/441

FOREIGN PATENT DOCUMENTS

GB 2144838 * 3/1985 ..... 62/198

* cited by examiner

*Primary Examiner*—William Wayner
(74) *Attorney, Agent, or Firm*—Staas & Halsey LLP

(57) ABSTRACT

A two-compartment cooling apparatus which achieves a plurality of refrigeration cycles by controlling refrigerant paths, thus increasing cooling efficiency and cooling speed of the cooling apparatus. A compressed refrigerant provided by a compressor is selectively provided to first and/or second evaporators via first, second and third expansion units and a path control unit. The path control unit controls the flow of the refrigerant through the expansion units and the evaporators to vary the cooling in the respective compartments in response to temperature measurements made in the respective compartments.

21 Claims, 8 Drawing Sheets

COOLING APPARATUS

CROSS-REFERENCE TO RELATED APPLICATION

This application claims the benefit of Korean Application No. 2002-68499, filed Nov. 6, 2002, in the Korean Intellectual Property Office, the disclosure of which is incorporated herein by reference.

BACKGROUND OF THE INVENTION

1. Field of the Invention

The present invention relates, in general, to cooling apparatuses and, more particularly, to a cooling apparatus with two or more cooling chambers which are independently cooled.

2. Description of the Related Art

Generally, a cooling apparatus of an independent cooling type is partitioned into two cooling chambers, that is, a freezer compartment and a refrigerator compartment, by a partition wall. Two doors are hinged to a cabinet of the apparatus, each of which opens and closes a respective one of the cooling chambers. An evaporator and a fan are mounted to an inside surface of the freezer compartment to produce cool air and supply the cool air to the freezer compartment. Similarly, the refrigerator compartment is provided on an inside surface with an evaporator and a fan to produce cool air and supply the cool air to the refrigerator compartment. That is, cool air is independently supplied into both the freezer compartment and the refrigerator compartment. Such a cooling technique is referred to as an independent cooling technique.

FIG. 1 is a view illustrating a closed refrigeration circuit for a conventional cooling apparatus. As illustrated in FIG. 1, the refrigeration circuit of the conventional cooling apparatus includes a compressor 101, a condenser 102, a capillary tube 104, a refrigerator compartment evaporator 105, and a freezer compartment evaporator 107 which are connected to each other by refrigerant pipes to perform a refrigeration cycle. In the apparatus shown in FIG. 1, the capillary tube 104 serves to expand a refrigerant. The refrigeration circuit of the conventional cooling apparatus also includes a first motor 103*a* to drive a condenser fan 103, a second motor 106*a* to drive a refrigerator compartment fan 106, and a third motor 108*a* to drive a freezer compartment fan 108.

In such a conventional cooling apparatus, the freezer compartment is used for storing frozen foods. The known optimum temperature range of the freezer compartment is in a range including −18° C. and −20° C. Meanwhile, the refrigerator compartment is used for storing non-frozen foods for a lengthy period of time to maintain the freshness of the food. The known optimum temperature range of the refrigerator compartment is in a range including −1° C. and 6° C.

As such, the optimum temperature range of the refrigerator compartment is different from that of the freezer compartment, but, in the conventional refrigerator, a refrigerant evaporating temperature of the refrigerator compartment evaporator 105 is equal to a refrigerant evaporating temperature of the freezer compartment evaporator 107. Thus, the temperature of the refrigerator compartment may be excessively and undesirably low. When the temperature of the refrigerator compartment is excessively low, an operating time of the refrigerator compartment fan 106 is appropriately controlled to prevent the refrigerator compartment from being overcooled. Since a pressure of the refrigerant in the capillary tube 104 is reduced according to the refrigerant evaporating temperature demanded by the freezer compartment evaporator 107, the above-mentioned problem arises. That is, when the extent of the pressure reduction is determined on the basis of the refrigerant evaporating temperature demanded by the freezer compartment evaporator 107, the refrigerant in the refrigerator compartment evaporator 105 evaporates at an excessively low temperature, so the temperature of the refrigerator compartment may fall below the optimum temperature. In this case, frost is formed on a surface of the refrigerator compartment evaporator 105, thus undesirably hindering the refrigerator compartment from maintaining a high percentage of humidity. Furthermore, the evaporating efficiency of the refrigerator compartment evaporator 105 becomes low, thus resulting in low cooling efficiency of the refrigerator. Since the refrigerant must be compressed in the compressor 101 considering the refrigerant evaporating temperature demanded by the freezer compartment evaporator 107, a load imposed on the compressor 101 is increased, so the energy efficiency ratio of the cooling apparatus is low.

SUMMARY OF THE INVENTION

Accordingly, it is an aspect of the present invention to provide a cooling apparatus which achieves various refrigeration cycles by controlling refrigerant paths, thus accomplishing optimum refrigerant evaporating temperatures demanded by a refrigerator compartment evaporator and a freezer compartment evaporator, and allowing either the refrigerator compartment or the freezer compartment to be independently cooled as desired, therefore increasing cooling efficiency and cooling speed of the cooling apparatus.

Additional aspects and advantages of the invention will be set forth in part in the description which follows and, in part, will be obvious from the description, or may be learned by practice of the invention.

The foregoing and/or other aspects of the present invention are achieved by providing a cooling apparatus, comprising a compressor to compress a refrigerant, first and second evaporators to evaporate the refrigerant compressed by the compressor, first, second, and third expansion units, and a path control unit. The first expansion unit is installed in series with an inlet of the first evaporator, and reduces a pressure of the refrigerant to expand the refrigerant prior to flowing into the first evaporator. The second and third expansion units are installed in series with an inlet of the second evaporator, and reduce a pressure of the refrigerant to expand the refrigerant prior to flowing into the second evaporator. The path control unit forms a first refrigerant path so that the refrigerant flowing from the first evaporator flows into either the second evaporator or the third expansion unit, forms a second refrigerant path so that the refrigerant flowing from the second expansion unit flows into the second evaporator, or forms a third refrigerant path so that the refrigerant flowing from the second expansion unit flows into the third expansion unit.

BRIEF DESCRIPTION OF THE DRAWINGS

The above and/or other aspects and advantages of the invention will become apparent and more readily appreciated from the following description of embodiments of the invention, taken in conjunction with the accompanying drawings of which.

DESCRIPTION OF THE PREFERRED EMBODIMENTS

Figure 1:
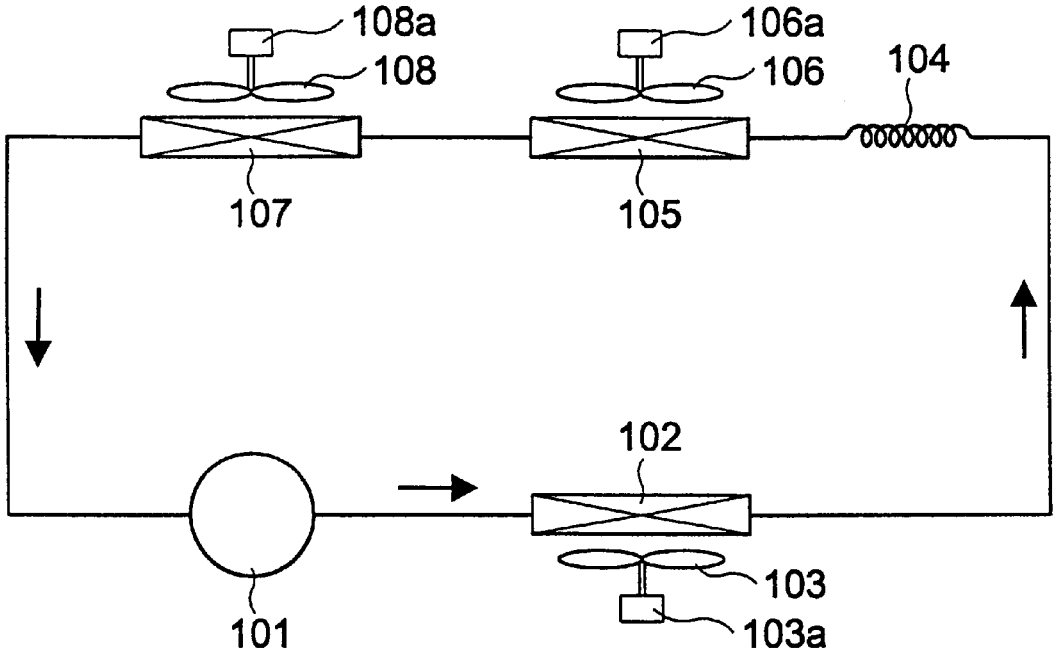
FIG. 1 (Prior Art)
FIG. 1 is a view illustrating a refrigeration circuit for conventional cooling apparatuses.

Reference will now be made in detail to embodiments of the present invention, examples of which are illustrated in the accompanying drawings, wherein like reference numerals refer to like elements throughout.

Figure 2:
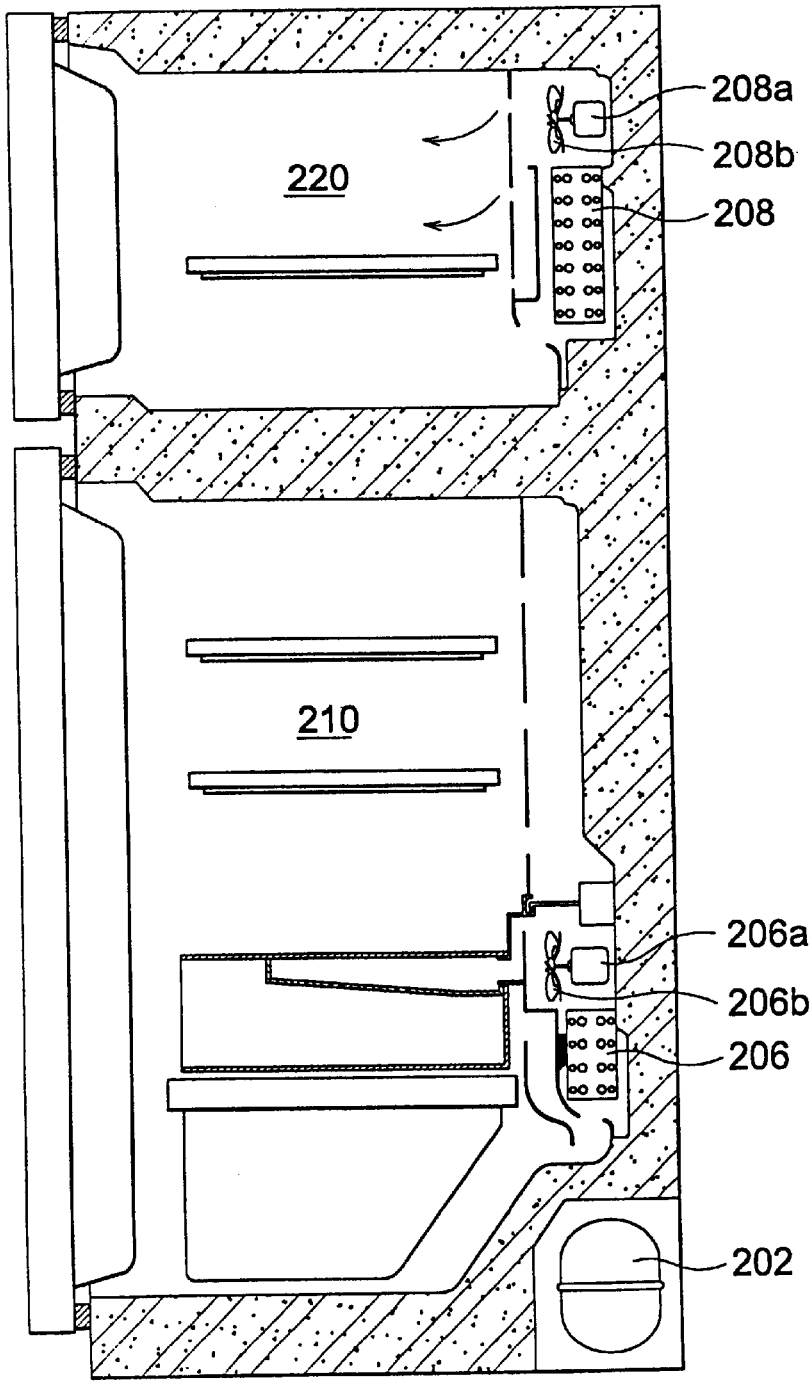
FIG. 2 is a sectional view illustrating a cooling apparatus according to an embodiment of the present invention.

FIG. 2 is a sectional view illustrating a cooling apparatus according to an embodiment of the present invention, in which a refrigerator is illustrated as an example of the cooling apparatus. As illustrated in FIG. 2, the refrigerator of the present invention comprises a refrigerator compartment 210 and a freezer compartment 220. An evaporator 206, a fan drive motor 206*a*, and a fan 206*b* are installed in the refrigerator compartment 210. Similarly, an evaporator 208, a fan drive motor 208*a*, and a fan 208*b* are installed in the freezer compartment 220. A compressor 202, a condenser 204 (see, FIG. 3), the refrigerator compartment evaporator 206, and the freezer compartment evaporator 208 are connected to each other by refrigerant pipes to form a refrigeration circuit.

Cool air, produced in the refrigerator compartment evaporator 206, is blown into the refrigerator compartment 210 by the refrigerator compartment fan 206*b*. Similarly, cool air, produced in the freezer compartment evaporator 208, is blown into the freezer, compartment 220 by the freezer compartment fan 208*b*. A refrigerator compartment capillary tube and a freezer compartment capillary tube are installed at a position around an inlet of the refrigerator compartment evaporator 206 and at a position around an inlet of the freezer compartment evaporator 208, respectively, so as to reduce a pressure of the refrigerant, although the two capillary tubes are not illustrated in FIG. 2.

Figure 3:
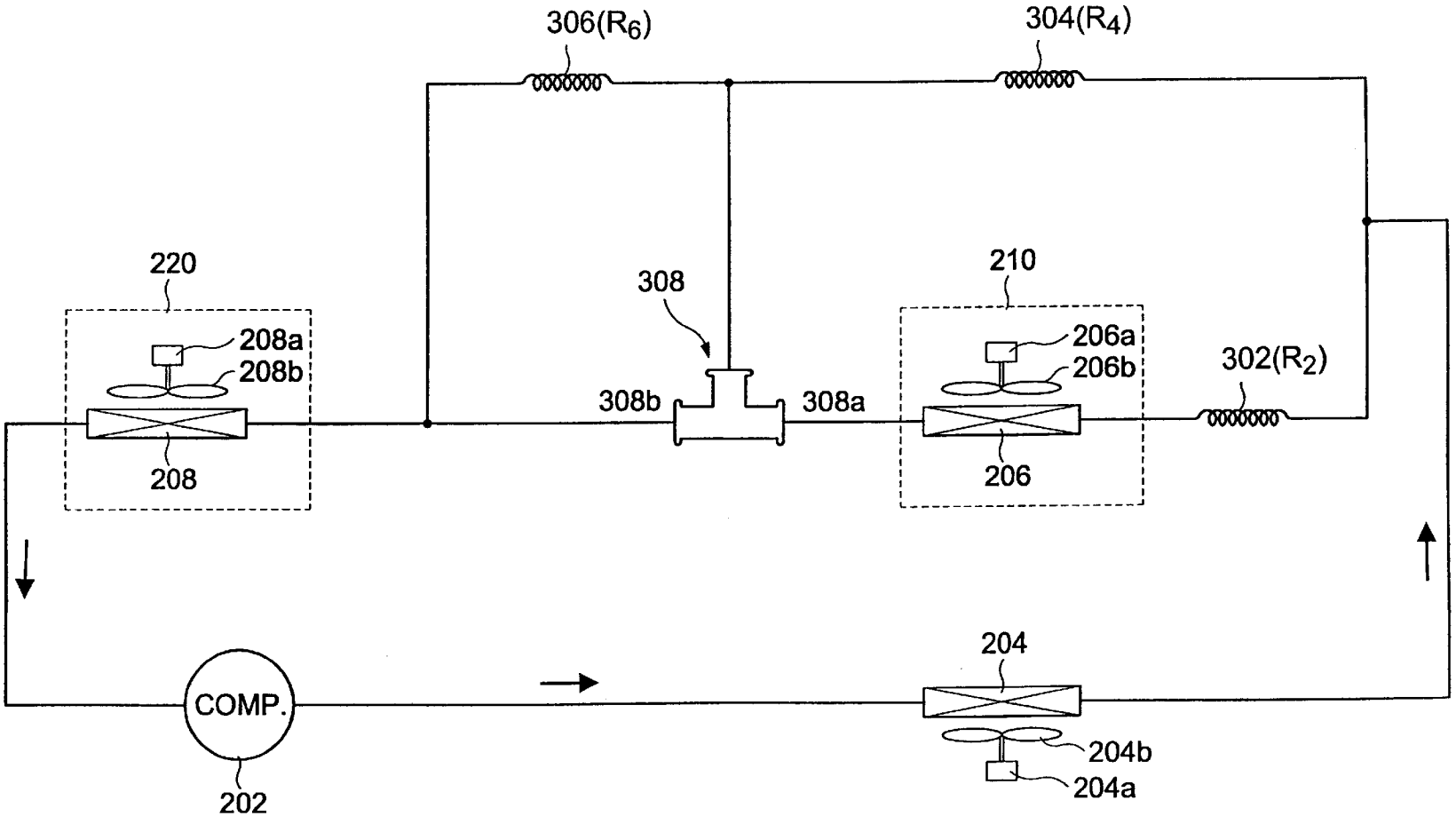
FIG. 3 is a view illustrating a refrigeration circuit of the cooling apparatus illustrated in FIG. 2.

FIG. 3 is a view illustrating a refrigeration circuit of the cooling apparatus illustrated in FIG. 2. As illustrated in FIG. 3, the refrigeration circuit of the cooling apparatus according to the present invention includes the compressor 202, the condenser 204, a first capillary tube 302, the refrigerator compartment evaporator 206, and the freezer compartment evaporator 208, which are connected to each other by refrigerant pipes so that the refrigerant flowing from the compressor 202 passes the condenser 204, the first capillary tube 302, the refrigerator compartment evaporator 206, and the freezer compartment evaporator 208, and then is returned to an inlet of the compressor 202. In the refrigeration circuit shown in FIG. 3, the flow of the refrigerant flowing from the condenser 204 is branched into two streams. That is, one of the two streams flows into the refrigerator compartment evaporator 206 through the first capillary tube 302, while the other stream flows into the freezer compartment evaporator 208 through a second capillary tube 304. In this case, the refrigerant flowing from the second capillary tube 304 passes through a third capillary tube 306 prior to flowing into the freezer compartment evaporator 208. The cooling apparatus of the present invention further comprises a first fan motor 204*a* to drive a condenser fan 204*b*, a second fan motor 206*a* to drive a refrigerator compartment fan 206*b*, and a third fan motor 208*a* to drive a freezer compartment fan 208*b*.

In FIG. 3, the first capillary tube 302 is used as a refrigerator compartment capillary tube. That is, the first capillary tube 302 reduces the pressure of the refrigerant flowing from the condenser 204 so that the refrigerant is easily evaporated in the refrigerator compartment evaporator 206. When the pressure of the refrigerant passing the refrigerator compartment evaporator 206 is excessive low, the refrigerant evaporating temperature of the refrigerator compartment evaporator 206 is excessively low, so the temperature of the refrigerator compartment 210 becomes excessively and undesirably low. Under such conditions, frost is formed on the refrigerator compartment evaporator 206, thus reducing the humidity in the refrigerator compartment 210, and resulting in a low cooling capability of the refrigerator compartment 210. Therefore, a diameter and a length of the first capillary tube 302 are determined so as to accomplish an appropriate reduction in pressure of the refrigerant, thus preventing the refrigerant evaporating temperature of the refrigerator compartment 210 from becoming excessively low. Meanwhile, the second and third capillary tubes 304 and 306 are used as freezer compartment capillary tubes. Of the second and third capillary tubes 304 and 306, the second capillary tube 304 is used for primarily reducing the pressure of the refrigerant so as to obtain a refrigerant evaporating temperature demanded by the freezer compartment evaporator 208. The third capillary tube 306 is used for secondarily reducing the pressure of the refrigerant which is primarily reduced in pressure in the second capillary tube 304, thus allowing the freezer compartment 220 to be more quickly cooled. Where resistance applied to the refrigerant in the first capillary tube 302 is designated as R2 and resistance applied to the refrigerant in the second capillary tube 304 is designated as R4, the relation between R2 and R4 is that R2 is less than R4. As described above, the capillary tubes are used as expansion units to expand refrigerant. However, it should be understood that the expansion units of the present invention may be selected from various types of expansion devices without being limited to the capillary tubes.

As illustrated in FIG. 3, a three-way valve 308 is used as a path control unit of the cooling apparatus according to the present invention. The three-way valve 308 is connected to an outlet of the refrigerator compartment evaporator 206, an inlet of the freezer compartment evaporator 208, and a line connecting the second and third capillary tubes 304 and 306. The cooling apparatus of the present invention further comprises a controller which controls the three-way valve 308 to control paths of the refrigerant flowing from the refrigerator compartment evaporator 206 or the second capillary tube 304. The mechanism and method of controlling the cooling apparatus according to the present invention will be described below with reference to FIG. 4.

Figure 4:
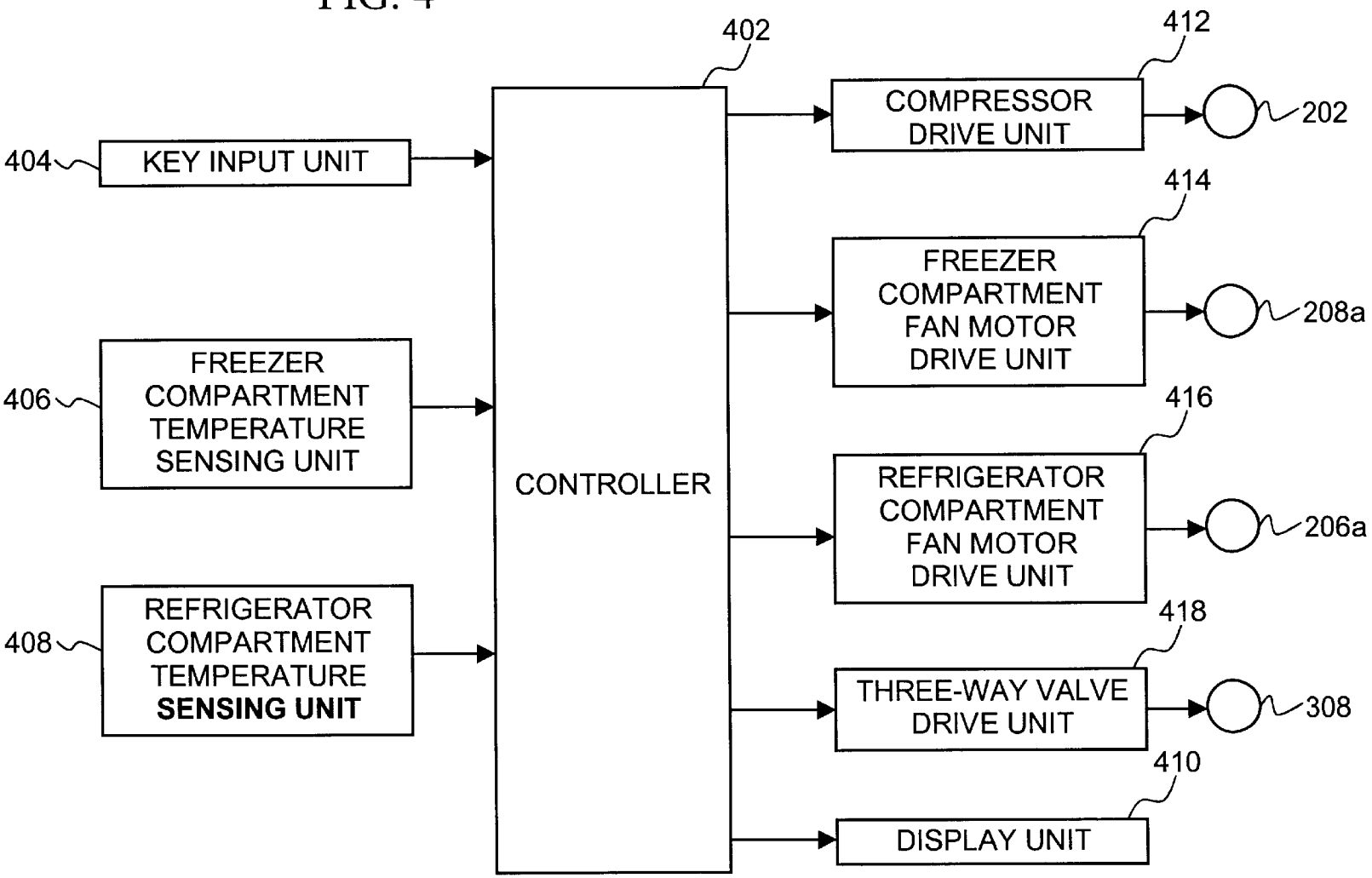
FIG. 4 is a block diagram illustrating a control mechanism of the cooling apparatus illustrated in FIG. 2.

As illustrated in FIG. 4, a key input unit 404, a freezer compartment temperature sensing unit 406 and a refrigerator compartment temperature sensing unit 408 are electrically connected to input terminals of a controller 402. The key input unit 404 is provided with a plurality of function keys so as to input a desired operating mode and desired operating conditions of the cooling apparatus, such as temperatures demanded by the refrigerator compartment and the freezer compartment. The freezer compartment temperature sensing unit 406 and the refrigerator compartment temperature sensing unit 408 sense the temperatures inside the freezer compartment 220 and the refrigerator compartment 210, respectively, and output signals indicating the sensed results to the controller 402. A display unit 410 is connected to an output terminal of the controller 402, and displays an operating state, several input values, and temperatures of the respective compartments in the cooling apparatus.

A compressor drive unit 412 to drive the compressor 202, a freezer compartment fan motor drive unit 414 to drive the freezer compartment fan motor 208*a*, a refrigerator compartment fan motor drive unit 416 to drive the refrigerator compartment fan motor 206*a*, and a three-way valve drive unit 418 to drive the three-way valve 308, are connected to output terminals of the controller 402.

Figure 5A:
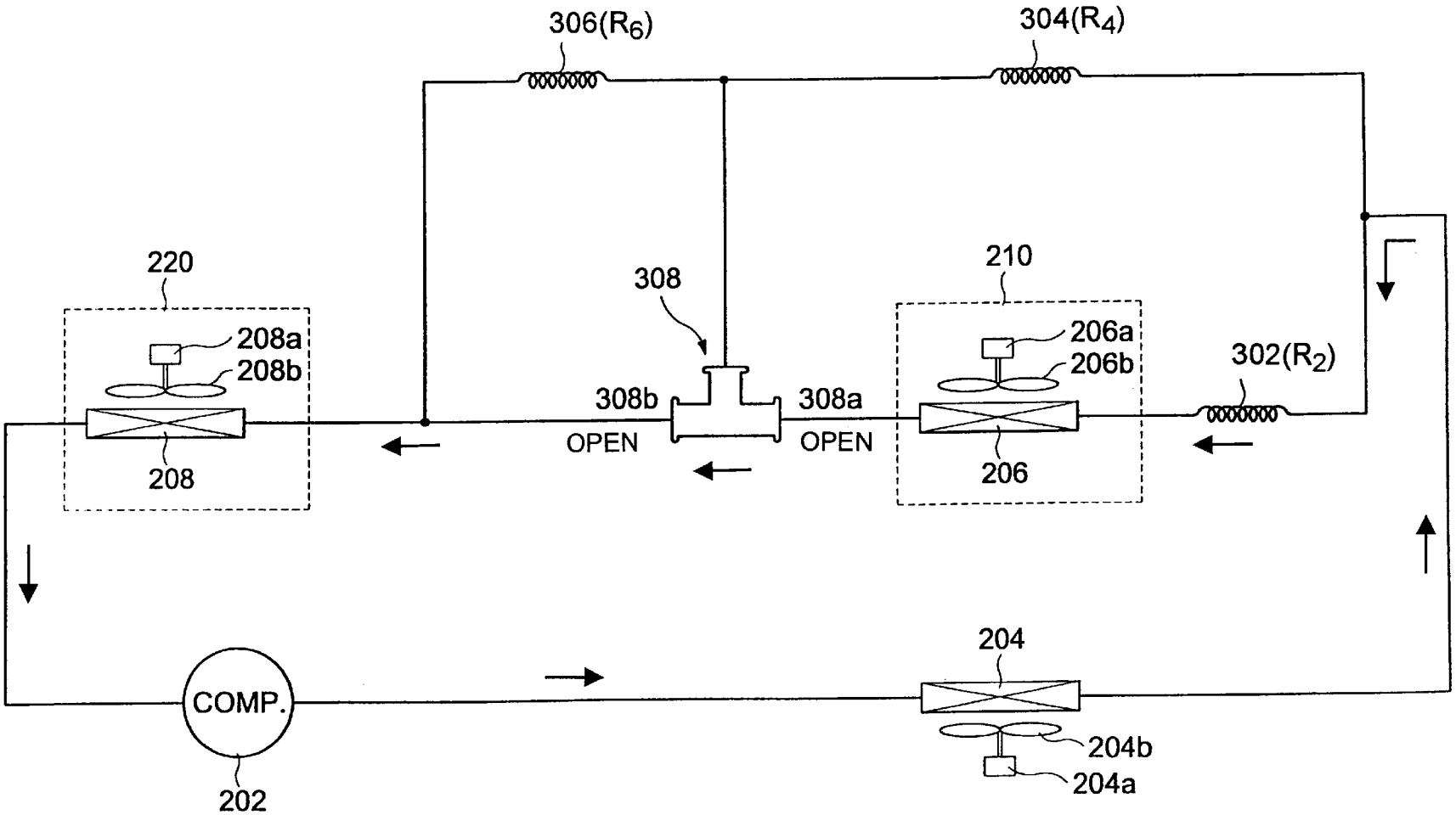
FIG. 5A is a view illustrating a first refrigerant path achieved in the refrigeration circuit of the cooling apparatus illustrated in FIG. 3, by controlling a three-way valve.

The controller 402 controls the three-way valve 308 to control the refrigerant paths according to a cooling mode required by the cooling apparatus of the present invention. The controller 402 controls the refrigerant paths by selectively opening or closing first and second ports 308*a* and 308*b*, respectively, of the three-way valve 308. That is, both ports 308*a* and 308*b* may be open, both ports 308*a* and 308*b* may be closed, or one of the ports 308*a* and 308*b* may be open and the other of the ports 308*a* and 308*b* may be closed, thus forming four different refrigerant paths. As such, various refrigerant paths formed by controlling the three-way valve 308 and different cooling modes performed with the refrigerant paths will be described below with reference to FIGS. 5A 5B, 5C and 5D. FIGS. 5A through to 5D are views illustrating first, second, third, and fourth refrigerant paths, respectively, achieved in the refrigeration circuit of the cooling apparatus illustrated in FIG. 3, by controlling the three-way valve. The arrows shown in FIGS. 5A through 5D denote refrigerant flowing directions.

FIG. 5A is a view illustrating a first refrigerant path, in which both the first and second ports 308*a* and 308*b* of the three-way valve 308 are open. As illustrated in FIG. 5A, when both the first and second ports 308*a* and 308*b* are open, the refrigerant flowing from the compressor 202 passes through the condenser 204 and flows into the first capillary tube 302, because the resistance R2 applied to the refrigerant in the first capillary tube 302 is smaller than the resistance R4 applied to the refrigerant in the second capillary tube 304. While the refrigerant passes the first capillary tube 302, the pressure of the refrigerant is reduced so that the refrigerant is expanded. The expanded refrigerant is evaporated in the refrigerator compartment evaporator 206 to cool the refrigerator compartment 210. In this case, the refrigerant flowing from the refrigerator compartment evaporator 206 passes the first and second ports 308*a* and 308*b* of the three-way valve 308, and flows into the freezer compartment evaporator 208. However, the pressure of the refrigerant flowing from the refrigerator compartment evaporator 206 is not further reduced, so the freezer compartment 220 is not cooled. When both the first and second ports 308*a* and 308*b* of the three-way valve 308 are open as shown in FIG. 5A, a refrigerant evaporating temperature of the refrigerator compartment evaporator 206 is the same as a refrigerant evaporating temperature of the freezer compartment evaporator 208, thus quickly cooling the refrigerator compartment 210.

Figure 5B:
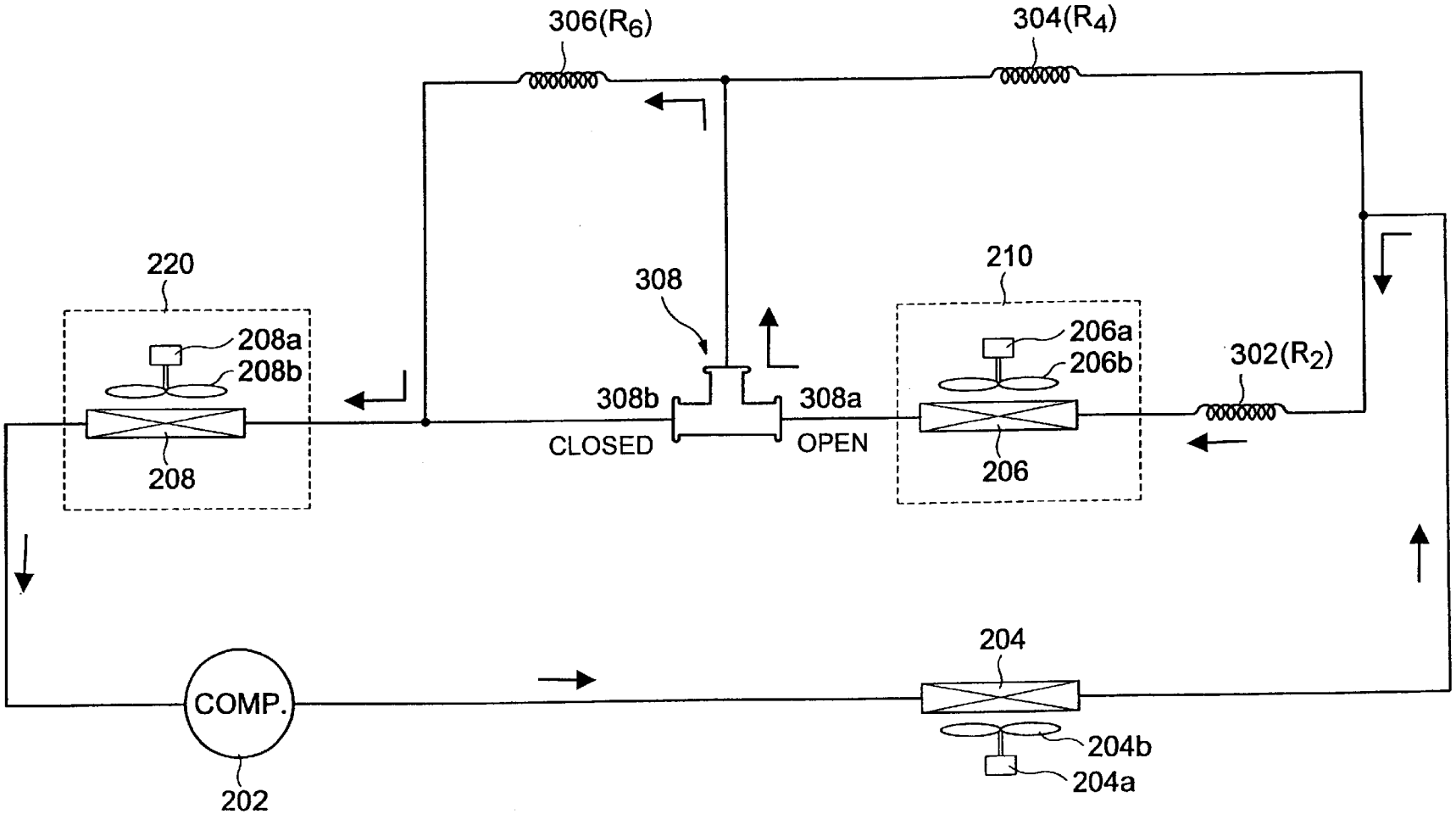
FIG. 5B is a view illustrating a second refrigerant path achieved in the refrigeration circuit of the cooling apparatus illustrated in FIG. 3, by controlling the three-way valve.

FIG. 5B is a view illustrating a second refrigerant path, in which the first port 308*a* is open and the second port 308*b* is closed. As illustrated in FIG. 5B, since the second port 308*b* is closed and R2 is smaller than R4, the refrigerant flowing from the condenser 204 passes the first capillary tube 302. At this time, the pressure of the refrigerant is reduced in the first capillary tube 302 so that the refrigerant is expanded. Thereafter, the expanded refrigerant is evaporated in the refrigerator compartment evaporator 206, thus cooling the refrigerator compartment 210. The refrigerant flowing from the refrigerator compartment evaporator 206 passes the third capillary tube 306. At this time, the pressure of the refrigerant flowing from the refrigerator compartment evaporator 206 is reduced once again by the third capillary tube 306, so that the refrigerant is expanded again. The expanded refrigerant is then evaporated in the freezer compartment evaporator 208, thus cooling the freezer compartment 220. In this case, the evaporating temperature of the refrigerator compartment evaporator 206 is higher than the evaporating temperature of the freezer compartment evaporator 208, so the formation of frost is reduced on the refrigerator compartment 210, thus maintaining a high percentage of humidity in the refrigerator compartment 210, and allowing food stored in the refrigerator compartment 210 to be kept fresh. Further, since the refrigerant pressure in the refrigerator compartment evaporator 206 is higher than the refrigerant pressure of the freezer compartment evaporator 208, the load imposed on the compressor 202 is reduced, thus enhancing the energy efficiency ratio of the cooling apparatus.

Figure 5C:
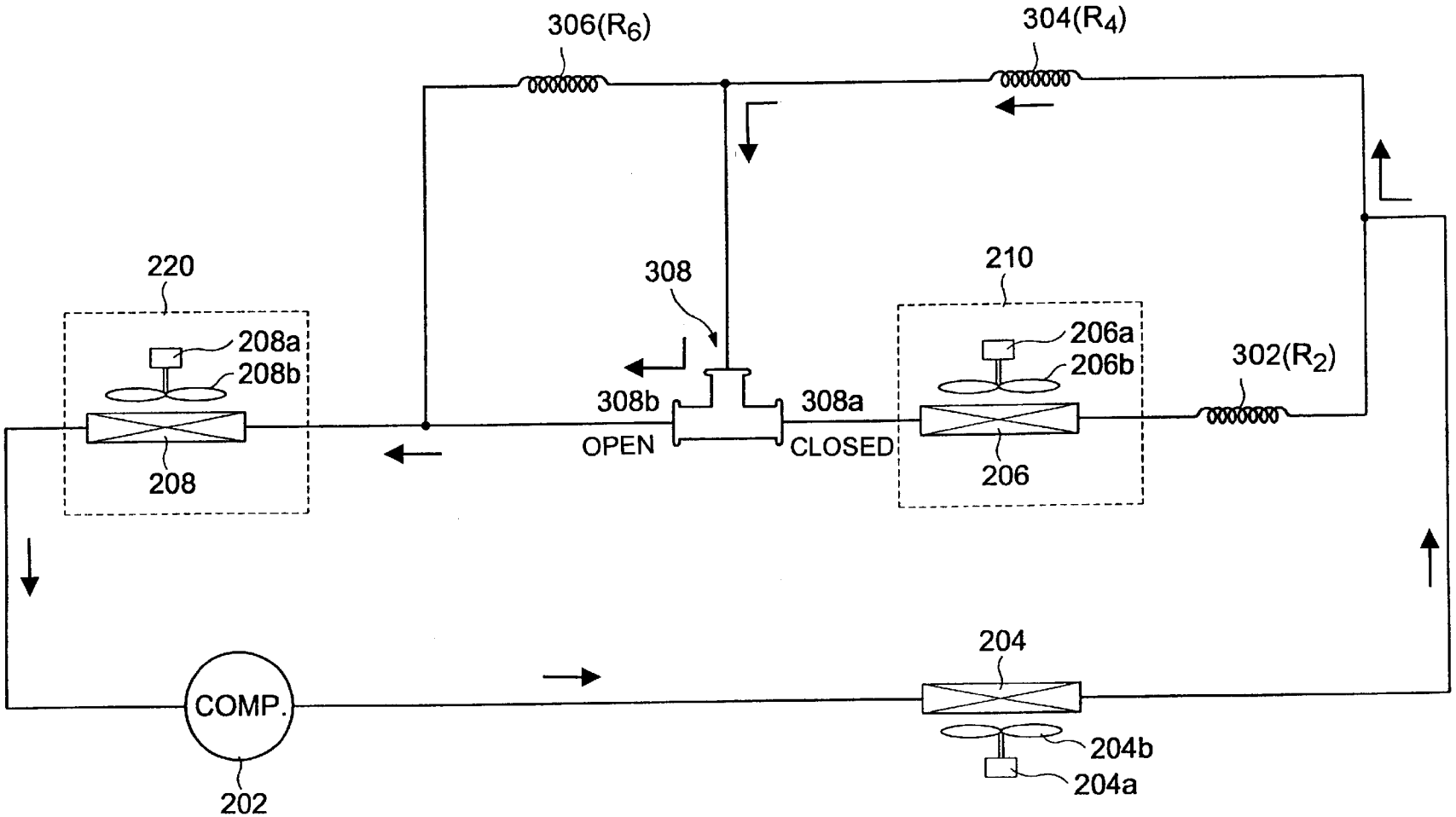
FIG. 5C is a view illustrating a third refrigerant path achieved in the refrigeration circuit of the cooling apparatus illustrated in FIG. 3, by controlling the three-way valve.

FIG. 5C is a view illustrating a third refrigerant path, in which the first port 308*a* is closed and the second port 308*b* is open. As illustrated in FIG. 5C, since the first port 308*a* of the three-way valve 308 is closed, the refrigerant flowing from the condenser 204 flows into the second capillary tube 304 although R4 is larger than R2. The pressure of the refrigerant is reduced in the second capillary tube 304 so that the refrigerant is expanded. The expanded refrigerant flows into the freezer compartment evaporator 208 through the second port 308*b*. The refrigerant is evaporated in the freezer compartment evaporator 208, thus cooling the freezer compartment 220. When the first port 308*a* is closed and the second port 308*b* is open as shown in FIG. 5C, only the freezer compartment 220 is cooled. That is, when the refrigerator compartment 210 reaches a predetermined target temperature and the temperature of the freezer compartment 220 is lower than a predetermined target point, the first port 308*a* of the three-way valve 308 is closed and the second port 308*b* of the three-way valve 308 is open, as illustrated in FIG. 5C, so as to cool only the freezer compartment 220, thus allowing the freezer compartment 220 to reach its target temperature while preventing the refrigerator compartment 210 from being overly cooled. In the cooling mode of FIG. 5C, only the freezer compartment 220 is cooled, while the refrigerator compartment 210 is not cooled, thus preventing frost from being formed on the refrigerator compartment 210, and reducing an operating time of the compressor 202, therefore reducing power consumption of the cooling apparatus.

Figure 5D:
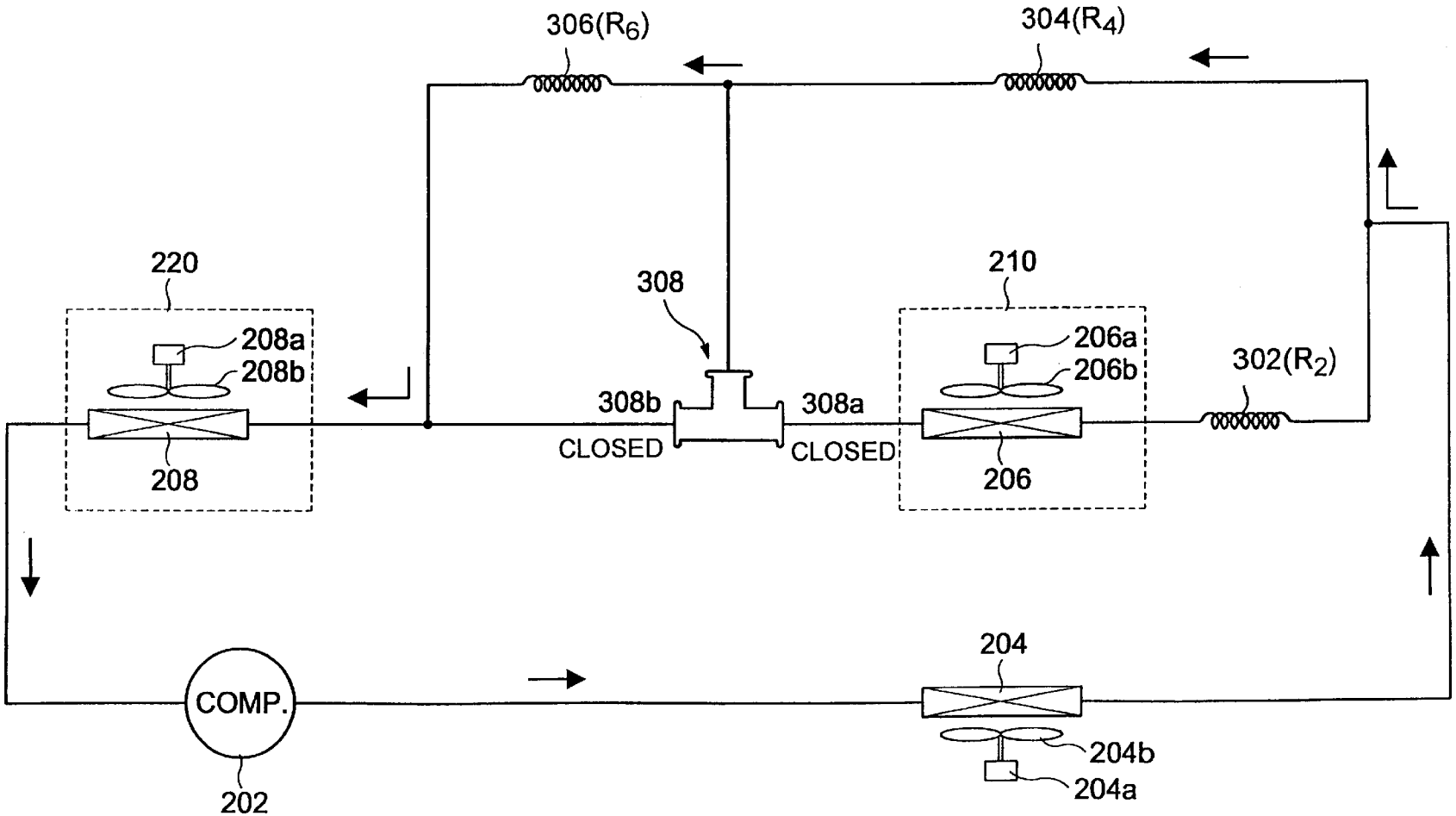
FIG. 5D is a view illustrating a fourth refrigerant path achieved in the refrigeration circuit of the cooling apparatus illustrated in FIG. 3, by controlling the three-way valve.

FIG. 5D is a view illustrating a fourth refrigerant path, in which both the first and second ports 308*a* and 308*b* of the three-way valve 308 are closed. As illustrated in FIG. 5D, since both the first and second ports 308*a* and 308*b* are closed, the refrigerant flowing from the condenser 204 is stepwisely reduced in pressure in the second and third capillary tubes 304 and 306, so that the refrigerant is expanded twice. Next, the expanded refrigerant flows into the freezer compartment evaporator 208 and is evaporated in the freezer compartment evaporator 208, thus more quickly cooling only the freezer compartment 220. In order to cool only the freezer compartment 220, both the first and second ports 308*a* and 308*b* of the three-way valve 308 may be closed, as illustrated in FIG. 5D. Alternatively, only the second port 308*b* may be opened, as illustrated in FIG. 5C. However, when both the first and second ports 308*a* and 308*b* are closed, as illustrated in FIG. 5D, a lower evaporating temperature is accomplished in the freezer compartment evaporator 208, in comparison with a case where the refrigerant is expanded by only the second capillary tube 304, as illustrated in FIG. 5C, thus increasing a cooling speed of the freezer compartment 220. Therefore, only the freezer compartment 220 is more effectively and quickly cooled.

The present invention may be applied to all types of apparatuses, including refrigerators, air conditioners, etc., operated according to a heat-exchanging process via the evaporation of a refrigerant.

As apparent from the above description, the present invention provides a cooling apparatus which is capable of achieving various refrigeration cycles by controlling refrigerant paths, thus accomplishing optimum refrigerant evaporating temperatures demanded by a refrigerator compartment evaporator and a freezer compartment evaporator, and allowing the refrigerator compartment and the freezer compartment to be selectively cooled, therefore increasing cooling efficiency and cooling speed of the cooling apparatus.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cooling apparatus, comprising:

a compressor to compress a refrigerant;

first and second evaporators to evaporate the compressed refrigerant;

a first expansion unit serially connected with the compressor and the first evaporator, and which reduces a pressure of the refrigerant to expand the refrigerant flowing into the first evaporator;

second and third expansion units serially connected with the compressor and the second evaporator and which reduce a pressure of the refrigerant to expand the refrigerant flowing into the second evaporator; and a path control unit which selectively forms refrigerant paths, wherein:

a first refrigerant path communicates the refrigerant flowing from the first evaporator into the second evaporator, a second refrigerant path communicates the refrigerant flowing from the first evaporator into the third expansion unit, a third refrigerant path communicates the refrigerant flowing from the second expansion unit into the second evaporator, and a fourth refrigerant path communicates the refrigerant flowing from the second expansion unit into the third expansion unit.

2. The cooling apparatus as set forth in claim 1, wherein a resistance applied to the refrigerant in the first expansion unit is smaller than a resistance applied to the refrigerant in the second expansion unit.

3. The cooling apparatus as set forth in claim 1, further comprising:

a controller which controls the path control unit to form one of the refrigerant paths according to a cooling condition.

4. The cooling apparatus as set forth in claim 1, wherein:

the first, second, and third expansion units each comprise a capillary tube.

5. The cooling apparatus as set forth in claim 1, wherein:

the path control unit comprises a valve having three ports, the first of the three ports being connected to a line connecting the second expansion unit to the third expansion unit, the second of the three ports being connected with an outlet of the first evaporator, and the third of the three ports being connected with an in let of the second evaporator.

6. A cooling apparatus, comprising:

a compressor to compress a refrigerant;

first and second evaporators to evaporate the refrigerant compressed by the compressor;

a first expansion unit serially connected with the compressor and the first evaporator, and which reduces a pressure of the refrigerant to expand the refrigerant flowing into the first evaporator;

second and third expansion units serially connected with the compressor and the second evaporator and which reduce a pressure of the refrigerant to expand the refrigerant flowing into the second evaporator; and a path control unit which communicates with:

an outlet of the first expansion unit and an inlet of the second expansion unit, an outlet of the first evaporator, and an inlet of the second evaporator, thus forming refrigerant paths; and a controller which controls the path control unit to control the refrigerant paths so that an extent of expansion of the refrigerant is controlled and the refrigerant is evaporated in either the first or second evaporator, or both the first and second evaporators.

7. The cooling apparatus as set forth in claim 6, wherein:

the controller controls the path control unit to form a refrigerant path between the first and second evaporators so that the refrigerant expanded in the first expansion unit is sequentially evaporated in the first and second evaporating units.

8. The cooling apparatus as set forth in claim 6, wherein:

the controller controls the path control unit to form a refrigerant path between the first evaporator and the third expansion unit so that the refrigerant expanded in the first expansion unit is evaporated in the first evaporator and the refrigerant expanded in the third expansion unit is evaporated in the second evaporator.

9. The cooling apparatus as set forth in claim 6, wherein;

the controller controls the path control unit to form a refrigerant path between the second expansion unit and the second evaporator so that the refrigerant flowing from the compressor is expanded in the second expansion unit and is evaporated in the second evaporator.

10. The cooling apparatus as set forth in claim 6, wherein:

the controller controls the path control unit to form a refrigerant path between the second and third expansion units so that the refrigerant flowing from the compressor is stepwisely expanded in the second and third expansion units, and is evaporated in the second evaporator.

11. A cooling apparatus, comprising:

a compressor to compress a refrigerant;

first and second evaporators to evaporate the refrigerant compressed by the compressor;

first and second cooling chambers cooled by the first and second evaporators, respectively;

a first expansion unit which reduces a pressure of the refrigerant to expand the refrigerant prior to flowing into the first evaporator;

second and third expansion units connected to each other in series and which reduce a pressure of the refrigerant to expand the refrigerant prior to flowing into the second evaporator;

a path control unit connected to a line which communicates the first expansion unit to the second expansion unit, an outlet of the first evaporator, and an inlet of the second evaporator, thus forming refrigerant paths; and a controller which controls the path control unit to control the refrigerant paths according to cooling conditions required by the first and second cooling chambers.

12. The cooling apparatus as set forth in claim 11, wherein:

the controller controls the path control unit to form a refrigerant path between the first and second evaporators so that the refrigerant expanded in the first expansion unit is sequentially evaporated in the first and second evaporators, thus quickly cooling the first cooling chamber.

13. The cooling apparatus as set forth in claim 11, wherein:

the controller controls the path control unit to form a refrigerant path between the first evaporator and the third expansion unit so that the refrigerant expanded in the first expansion unit is evaporated in the first evaporator and the refrigerant expanded in the third expansion unit is evaporated in the second evaporator, thus cooling both the first and second cooling chambers.

14. The cooling apparatus as set forth in claim 13, wherein:

the first evaporator has a higher evaporating temperature than an evaporating temperature of the second evaporator, when cooling both the first and second cooling chambers.

15. The cooling apparatus as set forth in claim 11, wherein:

the controller controls the path control unit to form a refrigerant path between the second expansion unit and the second evaporator so that the refrigerant flowing from the compressor is expanded in the second expansion unit and is evaporated in the second evaporator, thus cooling only the second cooling chamber.

16. The cooling apparatus as set forth in claim 11, wherein:

the controller controls the path control unit to form a refrigerant path between the second and third expansion units so that the refrigerant flowing from the compressor is stepwisely expanded in the second and third expansion units, and is evaporated in the second evaporator, thus quickly cooling only the second cooling chamber.

17. A refrigerator/freezer, comprising:

a compressor having an inlet and an outlet, and which compresses a refrigerant;

a refrigerator chamber;

a freezer chamber;

first and second evaporators to cool the refrigerator and freezer chambers, respectively, each of the first and second evaporators having an inlet and an outlet, the outlet of the second evaporator being in fluid communication with the inlet of the compressor;

first, second and third expansion units which expand the refrigerant, each of the first, second and third expansion units having an inlet and an outlet, the inlets of the first and second expansion units being in fluid communication with the outlet of the compressor, the outlet of the first expansion unit being in fluid communication with the inlet of the first evaporator, the outlet of the second expansion unit being in fluid communication with the inlet of the third expansion unit, and the outlet of the third expansion unit being in fluid communication with the inlet of the second evaporator;

a first temperature sensor which monitors a temperature in the refrigerator chamber;

a second temperature sensor which monitors a temperature in the freezer chamber;

a path control unit having a first port in fluid communication with the outlet of the first evaporator, a second port in fluid communication with the outlet of the second expansion unit and the inlet of the third expansion unit, and a third port in fluid communication with the outlet of the third expansion unit and the inlet of the second evaporator; and a controller which controls the path control unit to control a flow of the refrigerant through the first, second and third ports to selectively cool the refrigerator and freezer chambers in response to the first and second temperature sensors.

18. The refrigerator/freezer as set forth in claim 17, wherein:

a resistance of the second expansion unit is greater than a resistance of the first expansion unit; and the controller controls the path control unit to fluidly connect the first, second and third ports, thereby directing the refrigerant flow sequentially through the first expansion unit, the first evaporator and the second evaporator.

19. The refrigerator/freezer as set forth in claim 17, wherein:

a resistance of the second expansion unit is greater than a resistance of the first expansion unit; and the controller controls the path control unit to fluidly connect the first and third ports, thereby directing the refrigerant flow sequentially through the first expansion unit, the first evaporator, the third expansion unit and the second evaporator.

20. The refrigerator/freezer as set forth in claim 17, wherein:

the controller controls the path control unit to fluidly connect the second and third ports, thereby directing the refrigerant flow sequentially through the first expansion unit and the second evaporator.

21. The refrigerator/freezer as set forth in claim 18, wherein:

the controller controls the path control unit to fluidly disconnect the first, second and third ports, thereby directing the refrigerant flow sequentially through the first and second expansion units and the second evaporator, to cool only the freezer.

* * * * *